US009754566B2

(12) United States Patent
Reens et al.

(10) Patent No.: US 9,754,566 B2
(45) Date of Patent: Sep. 5, 2017

(54) ADJUSTABLE LINKAGE FOR DUAL DRUM PEDAL

(71) Applicants: Rusty D. Reens, Redondo Beach, CA (US); Mark D. Albright, Maumee, OH (US)

(72) Inventors: Rusty D. Reens, Redondo Beach, CA (US); Mark D. Albright, Maumee, OH (US)

( * ) Notice: Subject to any disclaimer, the term of this patent is extended or adjusted under 35 U.S.C. 154(b) by 0 days.

(21) Appl. No.: 15/011,389

(22) Filed: Jan. 29, 2016

(65) Prior Publication Data

US 2017/0221460 A1 Aug. 3, 2017

(51) Int. Cl.
*G10D 13/00* (2006.01)

(52) U.S. Cl.
CPC ..... *G10D 13/006* (2013.01)

(58) Field of Classification Search
CPC ..... G10D 13/024; G10D 13/026; G10H 2230/281; F16C 35/06
USPC ..... 84/422.1, 422.2, 422.3
See application file for complete search history.

(56) References Cited

U.S. PATENT DOCUMENTS 5,876,071 A * 3/1999 Aldridge ..... F16L 37/088 285/305
5,994,635 A * 11/1999 Hoshino ..... G10D 13/006 84/422.1

* cited by examiner

*Primary Examiner* — Kimberly Lockett
(74) *Attorney, Agent, or Firm* — Uleses C. Henderson, Jr.

(57) ABSTRACT

An apparatus for connecting drum pedals for a musical drum set is provided. The apparatus may include an outer tube having a proximal end and a distal end, the proximal end of the outer rod having a polygon-shaped channel extending therethrough, the distal end of the outer tube being coupled with a first drum pedal; an inner rod having a polygonal cross-section, a proximal end and a distal end, the proximal end of the inner rod being slidably received through the polygon-shaped channel at the proximal end of the outer tube, the distal end of the inner rod being coupled with a first drum beater; and a quick-release mechanism coupled to the proximal end of the outer tube configured to releasably engage the outer tube with the inner rod.

14 Claims, 6 Drawing Sheets

ADJUSTABLE LINKAGE FOR DUAL DRUM PEDAL

BACKGROUND INFORMATION

1. Field of Invention

The present disclosure relates generally to an apparatus for connecting two drum pedals of a drum and, more particularly, to an apparatus that provides quick and easy connection and adjustment of the connection between the drum pedals.

2. Background

A double drum pedal enables a performer to play a bass drum simultaneously with two feet. Devices for connecting two drum pedals of the double drum pedal assembly are known. For example, U.S. Pat. No. 5,905,218 discloses one such device. The device for connecting the drum pedals—often referred to as an adjustable linkage—includes an inner rod slidably coupled with an outer tube. Bolts are inserted through holes in the outer tube and abut on a circumference of the inner rod to secure the connection between the inner rod and the outer tube. The connecting mechanism has certain disadvantages. When the inner rod is adjusted with respect to the outer tube, it may be separated from the outer tube because there is no means for preventing the inner rod from slipping away from the outer tube. Moreover, it is difficult for the inner rod to return to its original position during reassembly. Another problem is that the tip portion of the bolt abutting on the circumference of the inner rod may scuff, strip, or otherwise cause damage to the inner rod.

U.S. Pat. No. 5,905,218 provides a resilient strip that is received in the recess of the outer tube and abuts the inner rod. A first end of the resilient strip has a protrusion integrally extending from one end thereof to be received in a through hole of the outer tube and a second end of the resilient strip is retained by a cutout of the inner rod. This mechanism can prevent damage to the inner rod and avoid separation of the inner rod from the outer tube. Further, in linkages adjusted by fasteners, the threads of the fasteners have a tendency to strip over time, thus requiring the user to drill a lager tap hole and use a larger fastener to secure the inner rod within the outer tube.

In the above examples, the linkages use bolts or screws for connecting the various parts and joints between the two drum pedals, and employ additional structures for preventing damage to the inner rod, avoiding separation of the inner rod from the outer tube, and preventing accidental falling away or idling of the screws.

Attempts have been made to address the problems associated with linkages that are adjusted by fasteners. One solution is to incorporate an apparatus including a quick-release mechanism configured to releasably engage the outer tube with the inner rod. U.S. Publ. No. 2009/0025533 discloses an example of such apparatus. In U.S. Publ. No. 2009/0025533, the linkage includes an outer tube having a distal end coupled to a first drum pedal and an inner rod having a distal end coupled to a second drum pedal, where the inner rod is slidably received through a proximal end of the outer tube. The quick-release mechanism includes a resilient engagement member that resiliently engages the outer tube with the inner rod and that is manually operable to disengage the outer to from the inner rod. The inner rod is an elongated circular bar including a plurality of notches. Each notches may be about ¼ inch in width and spaced apart at ½ inch increments. Accordingly, the engaging member can be manually released to disengage the engaging member from a notch by pressing a lever which, in turn, allows the inner rod to slide out of or relative to the outer tube. The problem with this published invention is that loose-tolerance between the ball bearings of the quick-release mechanism and the notches of the inner rod provides for inadvertent sliding of the inner rod within the outer rod when the inner rod and the outer rod are purported to be locked in place. The other problem with the published invention that the ½ inch increment spacing between the notches limits the user's ability adjust the linkage to more accurate spacing between the drum pedals.

Accordingly, a need therefore exists for a connecting mechanism that provides for quick and easy connection and adjustment of the linkage between two drum pedals of a drum, while overcoming the tolerance and adjustment issues that exist in linkage members presently known.

SUMMARY

An apparatus for connecting two drum pedals of a drum set is provided. In one example, the apparatus includes an outer tube having a proximal end and a distal end, where the proximal end of the outer rod includes a polygon-shaped channel that extends through the outer tube. The distal end of the outer tube is coupled with a first drum pedal.

The apparatus further includes an inner rod having a polygonal cross-section, a proximal end, and a distal end. The proximal end of the inner rod may be slidably received through the polygon-shaped channel at the proximal end of the outer tube, the distal end of the inner rod being coupled with a first drum beater.

A quick-release mechanism coupled to the proximal end of the outer tube is configured to releasably engage the outer tube with the inner rod. The quick-release mechanism includes a resilient engagement member that resiliently engages the outer tube with the inner rod and is manually operable to disengage the outer tube from the inner rod.

In some implementations, the inner rod includes two or more planar surfaces having a plurality of spaced detents extending along a substantial portion of the length of the inner rod. In this implementation, the resilient engagement member is attached to the outer tube near its proximal end and is spring-loaded to resiliently engage at least one of the detents on the inner rod.

The apparatus may further include a first quick-release member configured to connect the distal end of the outer tube with an operating shaft of the first drum pedal that rotates by actuation of the first drum pedal. A first universal joint may be coupled between the distal end of the outer tube and the first quick release member, where the first quick release member is configured to resiliently engage the first universal joint with the operating shaft of the first drum pedal.

The apparatus may additionally include a second quick-release member configured to removeably couple the distal end of the inner rod with a first rotary shaft that rotates with the first drum beater. A second universal joint may be coupled between the distal end of the inner rod and the second quick release member, where the second quick-release member is configured to removeably couple and engage the second universal joint with the first rotary shaft of the first drum beater. An alternative example of an apparatus for connecting two drum pedals of a drum set is further provided. In this example the apparatus includes an outer tube having a first end, a second end, and a polygon-shaped channel extending therethrough.

The apparatus further includes a first inner rod and a second inner rod. The first inner rod includes a polygonal cross-section, a proximal end, and a distal end, where the proximal end of the first inner rod may be slidably received through the first end of the outer tube and the distal end of the first inner rod may be coupled with a first drum pedal. The second inner rod includes a polygonal cross-section, a proximal end, and a distal end, where the proximal end of the second inner rod may be slidably received through the second end of the outer tube and the distal end of the second inner rod may be coupled with a first drum beater.

A first quick-release mechanism coupled to the first end is configured to releasably engage the outer tube with the first inner rod. The first quick-release mechanism includes a resilient engagement member that resiliently engages the outer tube with the first inner rod and is manually operable to disengage the outer tube from the first inner rod A second quick-release mechanism coupled to the second end is configured to releasably engage the outer tube with the second inner rod. The second quick-release mechanism includes a resilient engagement member that resiliently engages the outer tube with the second inner rod and is manually operable to disengage the outer tube from the second inner rod.

In some implementations, the first inner rod and the second inner rod both include two or more planar surfaces having a plurality of spaced detents extending along a substantial portion of the length of the rods. The first resilient engagement member is attached to the outer tube and spring-loaded to resiliently engage at least one of the detents on the first inner rod. The second resilient engagement member is attached to the outer tube and spring-loaded to resiliently engage at least one of the detents on the second inner rod.

The apparatus may also include a first quick-release member configured to removeably couple the distal end of the first inner rod with an operating shaft of the first drum pedal that rotates by actuation of the first drum pedal. A first universal joint may be coupled between the distal end of the first inner rod and the first quick release member for removeably and resiliently coupling the operating shaft of the first drum pedal with the first inner rod.

The apparatus may further include a second quick-release member configured to removeably couple the distal end of the second inner rod with a first rotary shaft that rotates with the first drum beater. A second universal joint may be coupled between the distal end of the second inner rod and the second quick-release member to resiliently engage the second inner rod with the first rotary shaft for the first drum beater.

Apparatuses of the present disclosure provide the several advantages over linkages of existing dual drum pedals. For instance, the present disclosure provides a tighter tolerance between the ball bearing of the quick-release mechanism and the detents in the inner rod, thus, preventing inadvertent sliding or movement between the inner rod and the outer tube when the inner rod is locked in place with the outer tube. Further, the present disclosure enables the linkage to be adjusted to small increments over the linkages used in existing dual drum pedals.

Other devices, apparatus, systems, methods, features and advantages of the disclosure will be or will become apparent to one with skill in the art upon examination of the following figures and detailed description. It is intended that all such additional systems, methods, features and advantages be included within this description, and be protected by the accompanying claims.

BRIEF DESCRIPTION OF THE FIGURES

The present disclosure may be better understood by referring to the following figures. The components in the figures are not necessarily to scale, emphasis instead being placed upon illustrating the principles of the disclosure. In the figures, like reference numerals designate corresponding parts throughout the different views.

DETAILED DESCRIPTION

Figure 1:
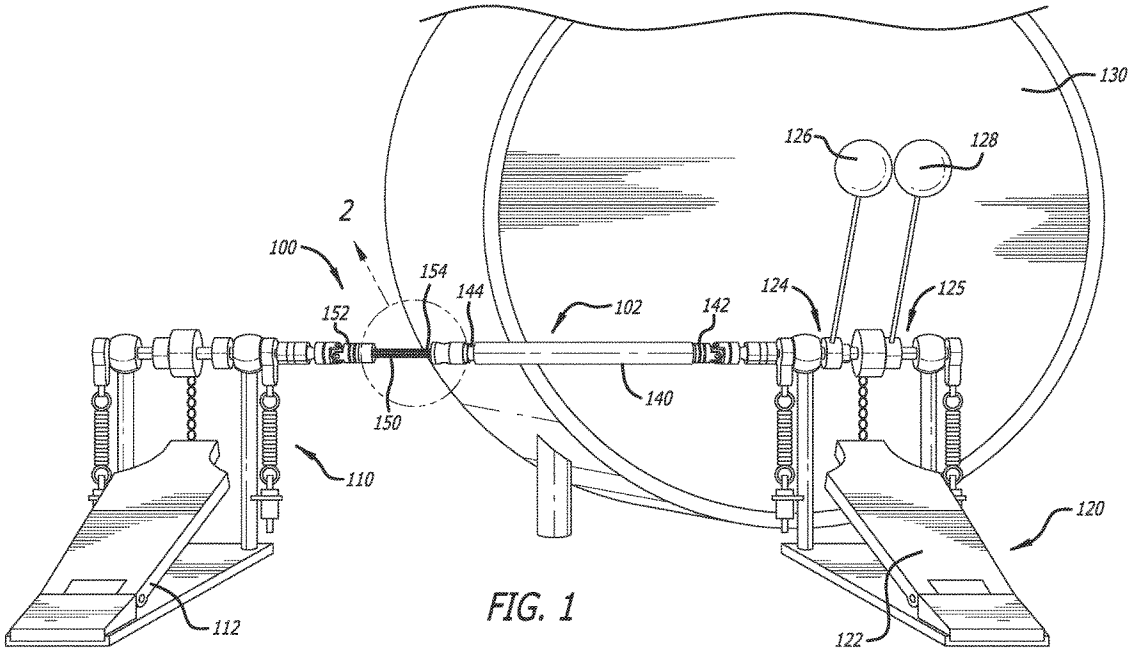
FIG. 1 is a perspective view of one example of an apparatus for connecting two drum pedals of a drum in accordance with the teachings of the present disclosure.

FIGS. 1-10 illustrate examples of various implementations of an adjustable drum pedal apparatus in accordance with the teachings of the present disclosure. In particular, FIG. 1 is a perspective view showing an apparatus 100 including an adjustable linkage 102 for connecting first and second drum pedals 110, 120 of a drum 130 in accordance with an implementation of the present disclosure. One example of an adjustable drum pedal apparatus is disclosed in U.S. Publication No. 2009/0025533, the disclosure of which is hereby incorporated by reference in its entirety.

When the two drum pedals 110, 120 are operated by a user, two drum beaters 126, 128 pivotedly connected therewith will be driven (the first beater 126 being driven by a first foot board 112 via the linkage 102 connecting the first drum pedal 110 and the first beater 126; the second beater 128 being driven by a second foot board 122) to hit the drum 130 respectively or simultaneously. The two beaters 126, 128 are disposed adjacent to one another and respectively operated by the right and left feet of a performer, for beating a single bass drum. In the implementation shown, the first drum pedal 110 may be actuated by the user's left foot and the second drum pedal 120 may be actuated by the user's right foot.

The linkage 102 includes an outer tube 140 and a telescoping inner rod 150 that are releasably connected with one another. The outer tube 140 is an elongated tubular member having a distal end 142 connected with the first beater 126 via a first rotary shaft 124 that rotates the first beater 126 by actuation of the first drum pedal 110 through the connecting linkage 102. The outer tube 140 further includes a proximal or free end 144 opposite the distal end 142. The outer tube 140 may be made of stainless steel, cast iron, aluminum, plastic, or any suitable material.

The inner rod 150 is a solid elongated member having a distal end 152 connected with the first drum pedal 110 via an operating shaft 114 that rotates by actuation of the foot plate 112. The inner rod 150 further includes a proximal or free end 154 that may be adjustably engaged with the free end 144 of the outer tube 140. The inner rod 150 may be made of stainless steel, cast iron, aluminum, plastic, or any suitable material. The second drum pedal 120 is connected to the second beater 128 via a second beater rotary shaft 125 that rotates the second beater 128 by actuation of the second foot board 122.

Figure 2A:
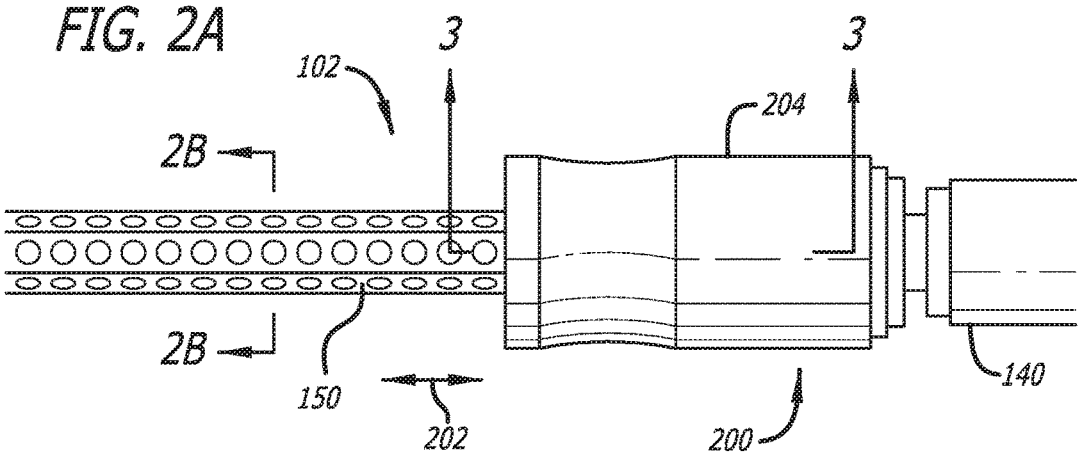
FIG. 2A is a partial exploded side view of the connection mechanism in the apparatus of FIG. 1.

FIG. 2A is a partial side view of the connection mechanism of linkage 102. As shown in FIG. 2A, the outer tube 140 and the inner rod 150 are releasably coupled by a quick-release connection mechanism 200 coupled to the free end 144 of the outer tube 140. The outer tube 140 and inner rod 150 serve as telescoping female and male members, respectively, that engage along an axial dimension in response to an engaging force that cause them to slide with respect to one another in the axial direction, as indicated by the double arrows 202. The quick-release mechanism 200 may have different configurations. In some implementations, the quick-release mechanism 200 may include a quick-release chuck.

Figure 2B:
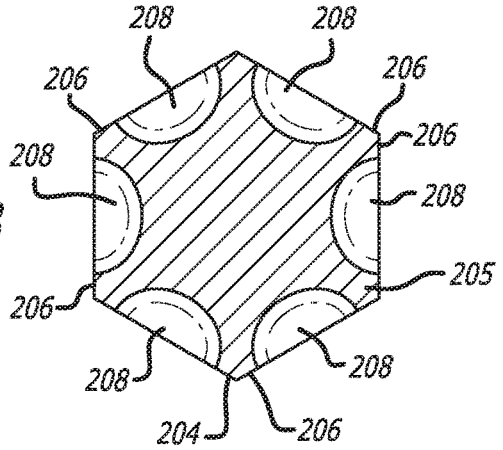
FIG. 2B is a cross-sectional view of the inner rod taken along line 2B-2B of the connection mechanism illustrated in FIG. 2A.

FIG. 2B is a cross-sectional view of the inner rod 150 along section 2B-2B. As shown, the inner rod 150 includes a polygon-shaped cross-section 205 comprising a plurality of angled planar surfaces or faces 206. The polygon shape of the cross section 205 provides that one face 206 is angularly offset from its adjacent faces 206.

Each angled face 206 includes a plurality of corresponding divots 208 machined or otherwise formed into the face 206 along a substantial portion of the length of the inner rod 150. In one implementation, the divots 208 may have spherical dimensions of about 3/16 inches and adjacent divots 208 may be spaced about 1/16 inches apart. The spherical dimensions of and spacing between the divots 208 may adjusted depending on the level of adjustment desired by the user.

Figure 3:
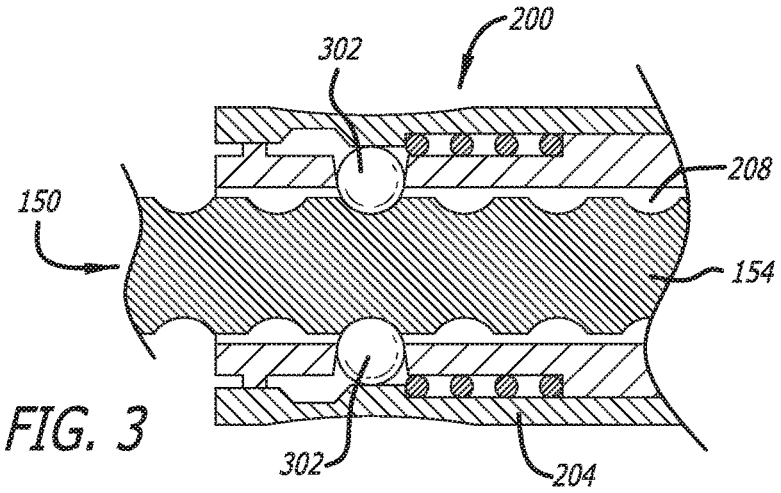
FIG. 3 is a partial cross-sectional view of the quick-release connection mechanism taken along line 3-3 of the connection mechanism illustrated in FIG. 2A.

FIG. 3 is a cross-sectional view of the connection mechanism shown in FIG. 2. As shown, the quick-release mechanism 200 includes a spring-loaded engaging member 204 that is resiliently biased toward the inner rod 150 to engage one or more ball bearings 302 into the divots 208 to lock the inner rod 150 in position with respect to the outer tube 140. In other implementations, the engaging member 204 may include one or more spring-loaded detent pins, latches or other suitable means that may be actuated to engage the divots 208. The quick-release mechanism 200 may employ a spring-loaded engagement member 204 with a notched structure or other suitable configurations.

Figure 4:
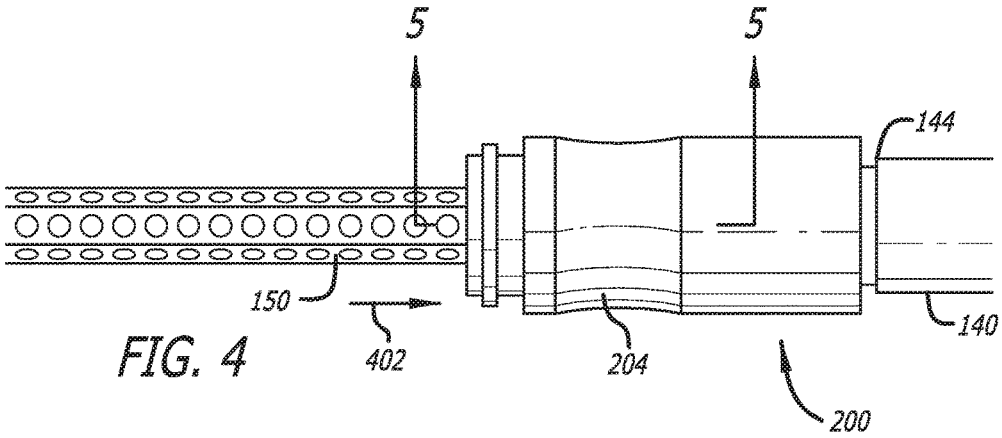
FIG. 4 is a partial exploded side view showing the quick-release connection mechanism of FIG. 2A in a disengaged or unlocked position.

The engaging member 204 can be manually released (e.g., translated away from the inner tube 150 as shown in FIG. 4) to disengage the ball bearings 302 from the divots 208, thus, allowing the inner rod 150 to slide out of the outer tube 140 or slide to a different position for engagement or locking between the ball bearings 302 and another divot 208 on the inner rod 150. As such, the spherical dimensions of the divots 208 should correspond to the spherical dimensions of the ball bearings 302 to produce a close mechanical fit that prevents sliding of the inner rod 150 with respect to the outer tube 140 when the ball bearings 302 are engaged with divots 208.

As the ball bearings 302 are disengaged from the divots 208, in an unlocked position of the quick-release mechanism 200, the relative axial movement between the inner rod 140 and the outer tube 150 allows the distance between the drum pedals 110, 120 to be adjusted (FIG.1). The engagement member 204 is provided to fix the inner rod 150 and the outer tube 140 in place when the desired distance between the drum pedals 110, 120 is achieved. In this way, there are no problems with loose screws falling away or accidental disconnection between the inner rod 150 and the outer tube 140 and associated damage to the inner rod 150. The connection mechanism is quick and reliable, and allows the adjustment and setup of the coupling between the inner rod 150 and the outer tube 140 to be made easily by one person.

Figure 5:
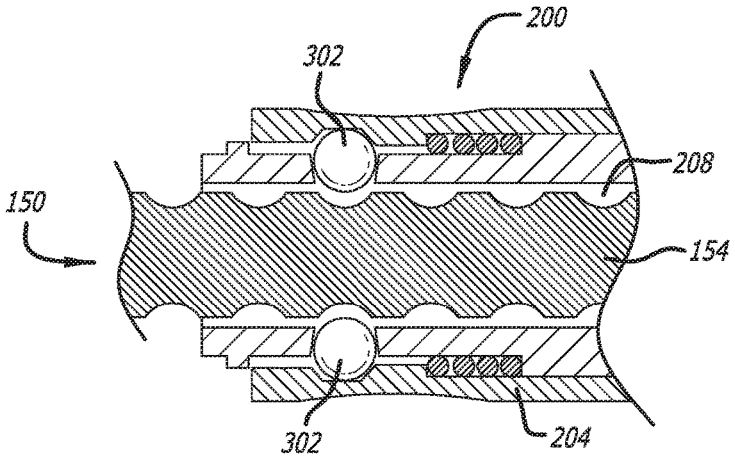
FIG. 5 is a partial cross-sectional view of the quick-release connection mechanism illustrated in FIG. 4.

FIG. 4 is a partial side view of the connection mechanism in linkage 102, where the quick-release mechanism 200 is shown in an unlocked position. FIG. 5 is a cross-sectional view of the connection mechanism as shown in FIG. 4.

As in FIGS. 4 and 5, in the unlocked position, the spring-loaded engaging member 204 is traversed away from the inner rod 150 (as shown in FIG. 4 by arrow 402) to disengage the ball bearings 302 from the divots 208. This permits axial movement of the inner rod 140 within the outer tube 150 to adjust the linkage between the first drum pedal 110 and the second drum pedal 120.

Figure 6:
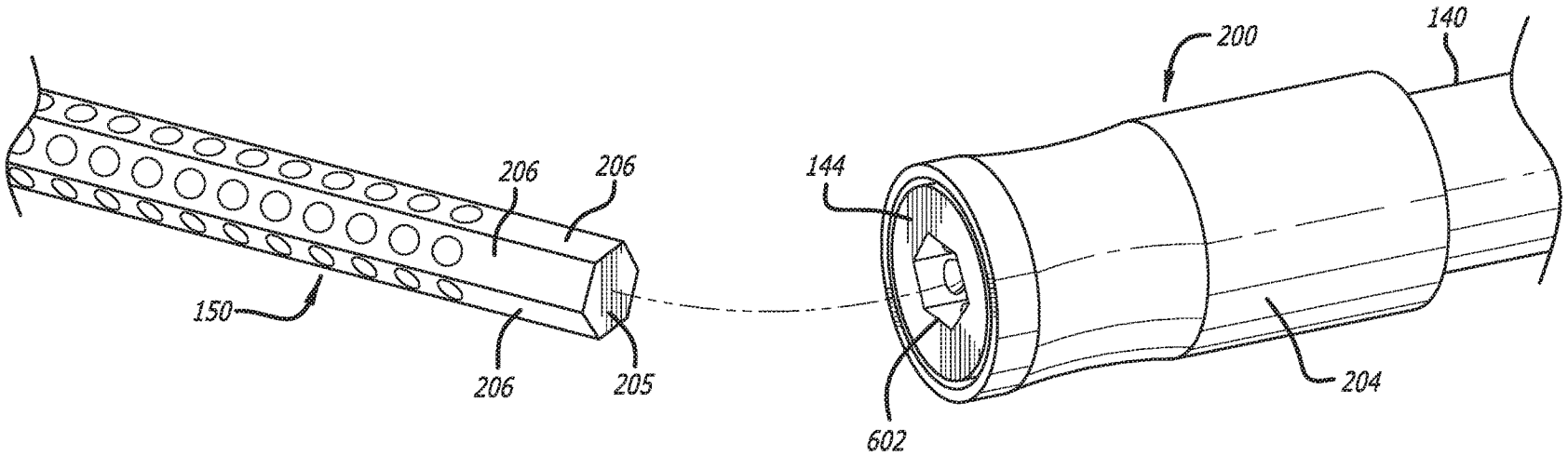
FIG. 6 is a partial perspective assembly view showing how the inner rod is slidably coupled with the outer tube in accordance with an one implementation of the present disclosure.

FIG. 6 is a partial assembly view showing the engagement of the inner rod 150 with the free end 144 of the outer tube 140. As shown, the free end 144 includes a polygon-shape channel 602 for telescopically receiving the free end 154 of the inner rod 150. The channel 602 (FIG. 6) corresponds in shape and dimensions with the cross-section 205 (FIG. 2B) of the inner rod 150. As further shown, the engaging member 204 is concentrically disposed about and may be axially translated relative to the free end 144 of the outer tube 140.

In the implementation shown, the corresponding shape of the inner rod 150 cross-section and the channel 602 is a hexagon. In other implantation, the corresponding shape of the inner rod cross-section 205 and the channel 602 may be a pentagon, square, triangle, or any other suitable polygon shape.

Figure 7:
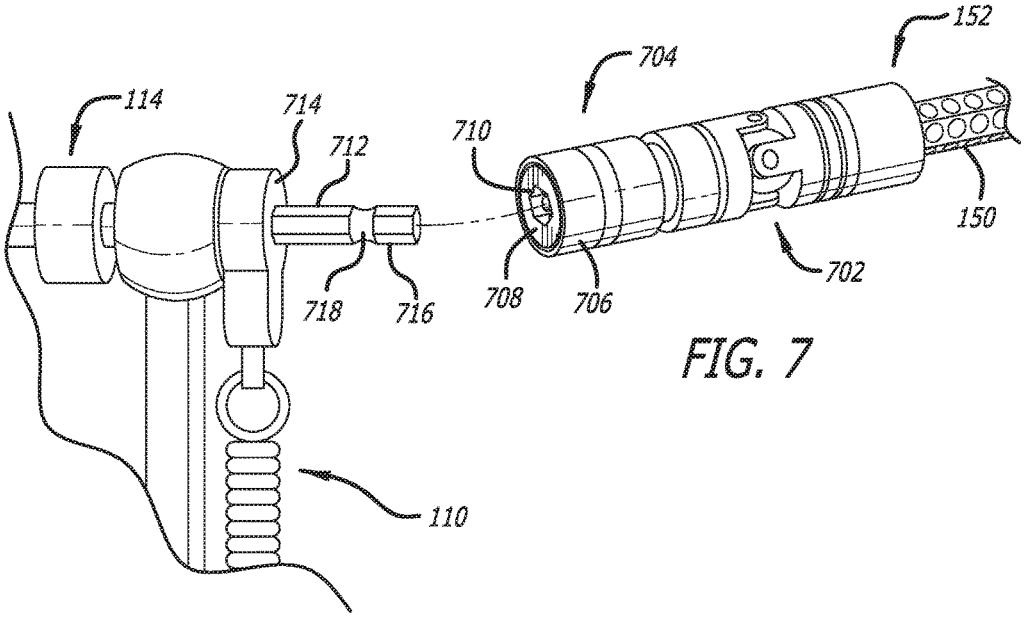
FIG. 7 is a partial perspective assembly view showing how the distal end of the inner rod is coupled to the operating shaft of the first drum pedal of FIG. 1.

FIG. 7 is a partial perspective view showing the assembly of the distal end 152 of the inner rod 150 to the operating shaft 114 of the first drum pedal 110. As shown, the distal end 152 of the inner rod 150 is connected to the operating shaft 114 of the first drum pedal 110 by a first universal joint 702 coupled to the distal end 152. The first universal joint 702 provides two degrees-of-freedom in which the inner rod 150 may bend and rotate relative to the operating shaft 114 of the first drum pedal 110.

The distal end 152 of the inner rod 150 further includes a quick-release member 704 coupled to the first universal joint 702. The quick-release member 704 is adapted to couple the first universal joint 702 to the operating shaft 114. The quick-release member 704 includes a spring-loaded outer annular engaging member 706, an inner shaft member 708, and a polygon-shaped inlet 710 for receiving a portion of the operating shaft 114. The operation of the quick-release member 704 is similar to the operation of the quick-release connection mechanism 200 described above and, accordingly, need not be described here in further detail.

The quick-release member 704 is adapted to disengagably couple to an axle 712 extending outwardly from an end 714 of the operating shaft 114. In the implementation shown, the axle 712 includes a polygon shaped cross-section 716 and a reduced diameter portion 718 for facilitating the engagement between quick-release member 704 and the operating shaft 114.

Figure 8:
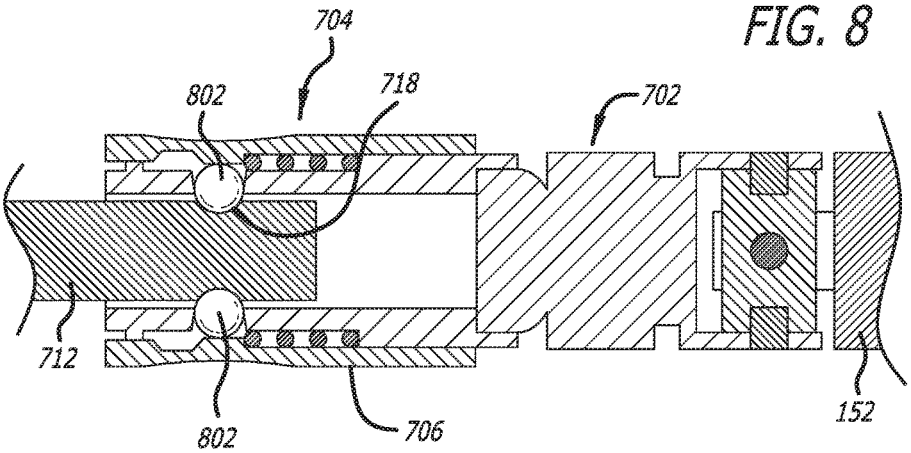
FIG. 8 is a partial cross-sectional view of the distal end of the inner rod of FIG. 1.

FIG. 8 is partial cross-sectional view showing the distal end 152 of the inner rod 150 engaged with the operating shaft 114 (FIG. 7). As illustrated, when the distal end 152 of the inner rod 150 is engaged with the operating shaft 114 (FIG. 7), the engaging member 706 is resiliently biased toward the operating shaft 114 to engage one or more ball bearings 802 into the reduced diameter portion 718 of the axle 712 to lock the quick-release member 704 onto the axle 712. In other implementations, the engaging member 704 may include one or more spring-loaded detent pins, latches, or other suitable means that may be actuated to engage the reduced diameter portion 718.

The engaging member 706 can be manually released to disengage the ball bearings 802 from the reduced diameter portion 718 to allow the axle 718 to slide out of the inlet 710. As such, the spherical dimensions of the reduced diameter portion 718 should correspond to the spherical dimensions of the ball bearings 702 to produce a close mechanical fit that prevents sliding or incidental disengagement of the axle 718 from the quick-release member 704 when the ball bearings 702 are engaged with reduced diameter portion 718.

Figure 9:
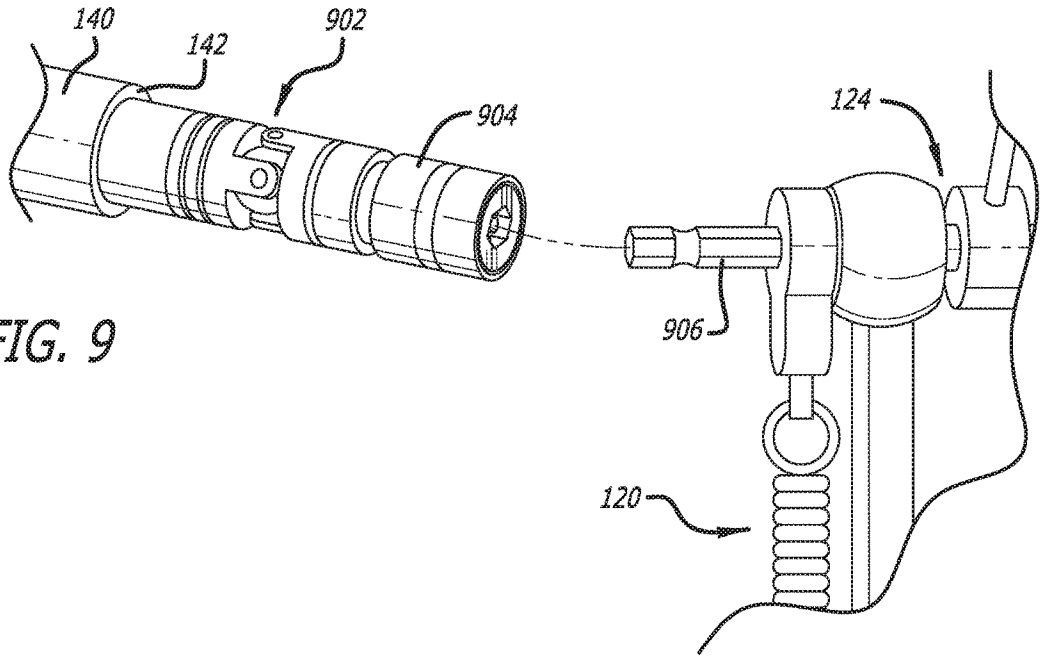
FIG. 9 is a partial perspective assembly view showing how the distal end of the outer rod is coupled to the first rotary shaft of the first beater illustrated in FIG. 1.

FIG. 9 is a partial perspective view showing the assembly of the distal end 142 of the outer tube 140 to the first rotary shaft 124 of the second drum pedal 120. As shown, the distal end 142 of the outer tube 140 may be connected to the first rotary shaft 124 of the second drum pedal 120 by a second universal joint 902 coupled to the distal end 142 of the outer tube 140. The second universal joint 902 provides two degrees-of-freedom in which the outer tube 140 may bend and rotate relative to the first rotary shaft 124 of the second drum pedal 120.

Similar to distal end 152 of the inner rod 150, as described above, the distal end 142 of the outer tube 140 further includes a quick-release member 904 coupled to second universal joint 902. The quick-release member 904 is adapted to couple the second universal joint 902 to the rotary shaft 124. Similar to quick-release member 704, quick-release member 904 is adapted to disengagably couple to an axle portion 906 of the first rotary shaft 124.

Referring back to FIG. 1, in operation, the operating shaft 114 of the first drum pedal 110 is rotated by the first foot board 112, and is operatively coupled to the first rotary shaft 124 through the adjustable linkage 102. The first rotary shaft 124 is journaled freely rotatably through a ball bearing 127 coupled to the first beater 126. As such, when the first drum pedal 110 is actuated, the first beater 126 is driven to beat the bass drum 130. The first and second universal joints 702 (FIG. 7), 146 allow the first drum pedal 110 to be linked at a selected angle with the second drum pedal 120.

The second rotary shaft 125 of the second drum pedal 120 is rotated by the second foot board 122. The second rotary shaft 125 is journaled through the ball bearing 127 to freely rotate independent of the first rotary shaft 124. As such, when the second drum pedal 110 is actuated, the second beater 128 is driven to beat the bass drum 130 independent of the first beater 126.

As commonly known of most dual bass drum pedals, the ball bearing 127 is provided integrally within one end of the first rotary shaft 124, making it possible for the second rotary shaft 125 to rotate independently of the first rotary shaft 124. Since the first drum pedal 110 and second drum pedal 120 can thereby independently activate the first beater 126 and the second beater 128, the desired performance can be carried out by the performer using either the left or the right foot.

Figure 10:
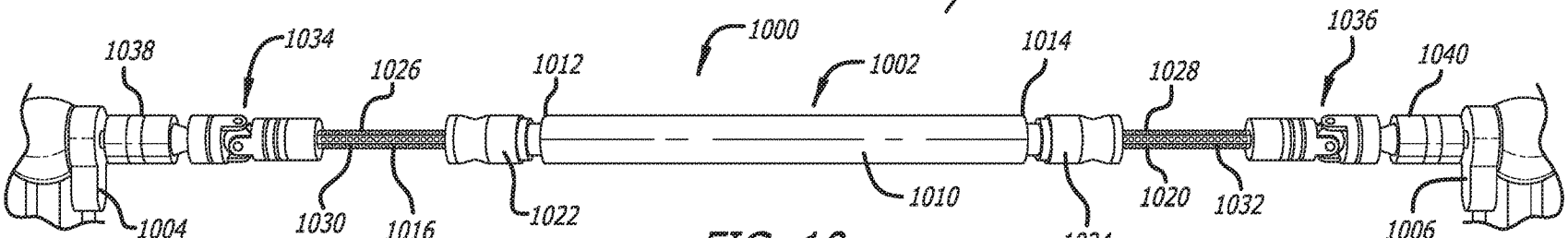
FIG. 10 is a perspective view of a second example of an apparatus for connecting two drum pedals of a drum in accordance with the teachings of the present disclosure.

FIG. 10 is a partial front view of a second implementation of an apparatus 1000 including an adjustable linkage 1002 for connecting first and second drum pedals 1004, 1006 of a drum in accordance with an implementation of the present disclosure. The linkage 1002 includes a hollowed outer tube 1010 having a first end 1012 and a second end 1014, a first inner rod 1016, and a second inner rod 1020. In this implementation, the outer tube 1010 serves as a telescoping female member, and the inner rods 1016, 1020 as telescoping male members that engage along an axial dimension in response to an engaging force that cause them to slide with respect to one another in the axial direction.

The inner rods 1016, 1020 are adjustably coupled to slide in-and-out of the outer tube 1010 by quick-release mechanisms 1022, 1024 coupled to the first end 1012 and the second end 1014 of the outer tube 1010, respectively. Each quick release-mechanism 1022, 1024 is a quick connect/disconnect coupler used to releasably connect the inner rods 1016, 1020 to the outer tube 1010.

In the implementation shown, the inner rods 1016, 1020 each have a polygon cross section defining a plurality of planar surfaces or faces 1026, 1028, where each face 1026, 1028 includes a plurality of divots or detents 1030, 1032 formed along a substantial portion of the inner rod length. Each quick release-mechanism 1022, 1024 may include spring-loaded engaging members that are resiliently biased toward the inner rods 1016, 1020 to engage one or more of the detents 1030, 1032, respectively, to lock the inner rods 1016, 1020 in position with respect to the outer tube 1010. The engaging members can be manually released to disengage the engaging member from the detents 1030, 1032 to allow the inner rods 1016, 1020 to slide in-and-out of the outer tube 1010 or slide to a different position to engage or lock the rods in place, respectively. The relative axial movements between the inner rods 1016, 1020 and the outer tube 1010 allow the distance between the pedals 1004, 1006 to be adjusted. The quick-release mechanisms 1022, 1024 fix the inner rods 1016, 1020 and the outer tube 1010 in place, respectively, when the desired distance is achieved.

The distal end of the first inner rod 1016 may be connected to a rotary beater shaft of the first drum pedal 1004 by a first universal joint 1034. The far distal end of the second inner rod 1020 may be connected to a second beater rotary shaft of the second drum pedal 1006 by a second universal joint 1036. As a further way of facilitating the easy and quick setup of the linkage 1000 for connecting the drum pedals 1004, 1006, a first quick-release member 1038 may be is used to connect the distal end of the first inner rod 1016 and the first beater rotary shaft, and a second quick-release member 1040 may be used to connect the distal end of the second inner rod 1020 and the second beater rotary shaft. As seen in FIG. 9, the first quick-release member 1038 is disposed between the first universal joint 1034 and the first beater rotary shaft, while the second quick-release member 1040 is disposed between the second universal joint 1036 and the second beater rotary shaft. The quick-release members 1038, 1040 allow the first and second beater rotary shafts to be quickly and easily connected to and disconnected from the first and second inner rods 1016, 1020, respectively.

Turning back to FIG. 1, adjustable linkages 102 of the present disclosure transmit the rotation of the operating shaft 114, which is caused by operation of the first foot plate 112 of the first drum pedal 110, to the first rotary shaft 124 supported on the second first pedal 120. The linkage 102 is joined with the operating shaft 114 at one end and with the first rotary shaft 124 at the other end through the respective universal joints 702 (FIGS. 7) and 902 (FIG. 9) at both ends of the linkage 102. In this way, the first drum pedal 110 and the second pedal 120 may be freely arranged by a performer at any orientation with respect to each other, to be selected by the performer using the pedals.

The linkages 102 of the present disclosure provide an adjustable structure which enables the distance and the relative orientations between the first drum pedal 110 and the second pedal 120 to be set for the convenience of the performer.

Adjustable linkages of the present disclosure provide the several advantages over the linkages of existing dual drum pedals. For instance, the present disclosure provides a tighter tolerance between the ball bearing of the quick-release mechanism and the detents in the inner rod, thus, preventing inadvertent sliding or movement between the inner rod and the outer tube when the inner rod is locked in place with the outer tube. Further, the present disclosure enables the linkage to be adjusted to small increments over the linkages used in existing dual drum pedals.

While the implementations described herein describe the apparatus as connecting or linking two base drum pedals, a person of ordinary skill in the art would appreciate that the apparatus of the present disclosure may be incorporated to operatively connect or link three or more pedals together. In general, terms such as "coupled to," and "configured for coupling to," and "secured to," and "configured for securing to," and "in communication with" (for example, a first component is "coupled to" or "is configured for coupling to" or is "configured for securing to" or is "in communication with" a second component) are used herein to indicate a structural, functional, mechanical, electrical, signal, optical, magnetic, electromagnetic, ionic, or fluidic relationship between two or more components or elements. As such, the fact that one component is said to be in communication with a second component is not intended to exclude the possibility that additional components may be present between, and/or operatively associated or engaged with, the first and second components.

Although the previous description illustrates particular examples of various implementations, the present disclosure is not limited to the foregoing illustrative examples. A person skilled in the art is aware that the disclosure as defined by the appended claims and their equivalents can be applied in various further implementations and modifications. In particular, a combination of the various features of the described implementations is possible, as far as these features are not in contradiction with each other. Accordingly, the foregoing description of implementations has been presented for purposes of illustration and description. Modifications and variations are possible in light of the above description.

What is claimed is:

1. An apparatus for connecting two drum pedals of a drum set, the apparatus comprising:

an outer tube having a proximal end and a distal end, the proximal end of the outer rod having a polygon-shaped channel extending therethrough, the distal end of the outer tube being coupled with a first drum pedal;

an inner rod having a polygonal cross-section, a proximal end and a distal end, the proximal end of the inner rod being slidably received through the polygon-shaped channel at the proximal end of the outer tube, the inner rod including two or more planar surfaces having a plurality of spaced spherical-shaped detents extending along a substantial portion of the length of the inner rod, the distal end of the inner rod being coupled with a first drum beater; and a quick-release mechanism coupled to the proximal end of the outer tube configured to releasably engage the outer tube with the inner rod, the quick-release mechanism including a resilient engagement member that resiliently engages the outer tube with the inner rod and that is manually operable to disengage the outer tube from the inner rod.

2. The apparatus of claim 1, wherein the resilient engagement member is attached to the outer tube and spring-loaded to resiliently engage at least one of the detents on the inner rod.

3. The apparatus of claim 2, wherein the resilient engagement member is disposed near the proximal end of the outer tube.

4. The apparatus of claim 1, further comprising a first quick-release member configured to connect the distal end of the outer tube with an operating shaft of the first drum pedal that rotates by actuation of the first drum pedal.

5. The apparatus of claim 4, further comprising a first universal joint coupled between the distal end of the outer tube and the first quick release member, wherein the first quick release member is configured to resiliently engage the first universal joint with the operating shaft of the first drum pedal.

6. The apparatus of claim 1, further comprising a second quick-release member configured to removeably couple the distal end of the inner rod with a first rotary shaft that rotates with the first drum beater.

7. The apparatus of claim 6, further comprising a second universal joint coupled between the distal end of the inner rod and the second quick release member, wherein the second quick-release member is configured to removeably couple and engage the second universal joint with the first rotary shaft of the first drum beater.

8. An apparatus for connecting two drum pedals of a drum set, the apparatus comprising:

an outer tube having a first end, a second end, and a polygon-shaped channel extending therethrough;

a first inner rod having a polygonal cross-section, a proximal end and a distal end, the proximal end of the first inner rod being slidably received through the first end of the outer tube, the first inner rod including two or more planar surfaces having a plurality of spaced spherical-shaped detents extending along a substantial portion of the length of the first inner rod, the distal end of the first inner rod being coupled with a first drum pedal;

a second inner rod having a polygonal cross-section, a proximal end and a distal end, the proximal end of the second inner rod being slidably received through the second end of the outer tube, the second inner rod including two or more planar surfaces having a plurality of spaced spherical-shaped detents extending along a substantial portion of the length of the second inner rod, the distal end of the second inner rod being coupled with a first drum beater;

a first quick-release mechanism coupled to the first end configured to releasably engage the outer tube with the first inner rod, the first quick-release mechanism including a resilient engagement member that resiliently engages the outer tube with the first inner rod and that is manually operable to disengage the outer tube from the first inner rod; and a second quick-release mechanism coupled to the second end configured to releasably engage the outer tube with the second inner rod, the second quick-release mechanism including a resilient engagement member that resiliently engages the outer tube with the second inner rod and that is manually operable to disengage the outer tube from the second inner rod.

9. The apparatus of claim 8, wherein wherein the first resilient engagement member is attached to the outer tube and spring-loaded to resiliently engage at least one of the detents on the first inner rod.

10. The apparatus of claim 8, wherein the second resilient engagement member is attached to the outer tube and spring-loaded to resiliently engage at least one of the detents on the second inner rod.

11. The apparatus of claim 8, further comprising a first quick-release member configured to removeably couple the distal end of the first inner rod with an operating shaft of the first drum pedal that rotates by actuation of the first drum pedal.

12. The apparatus of claim 11, further comprising a first universal joint coupled between the distal end of the first inner rod and the first quick release member for removeably and resiliently coupling the operating shaft of the first drum pedal with the first inner rod.

13. The apparatus of claim 8, further comprising a second quick-release member configured to removeably couple the distal end of the second inner rod with a first rotary shaft for the first drum beater that rotates with the first drum beater.

14. The apparatus of claim 13, further comprising a second universal joint coupled between the distal end of the second inner rod and the second quick-release member to resiliently engage the second inner rod with the first rotary shaft for the first drum beater.

* * * * *